US005258589A

United States Patent [19]

Perret

[11] Patent Number: 5,258,589

[45] Date of Patent: Nov. 2, 1993

[54] HIGH- AND MEDIUM-VOLTAGE CIRCUIT BREAKER WITH LOWER OPERATING ENERGY

[75] Inventor: Michel Perret, Bourgoin-Jallieu, France

[73] Assignee: GEC Alsthom SA, Paris, France

[21] Appl. No.: 917,333

[22] Filed: Jul. 23, 1992

[30] Foreign Application Priority Data

Jul. 24, 1991 [FR] France ..... 91 09355

[51] Int. Cl.[5] ..... H01H 33/88

[52] U.S. Cl. ..... 200/148 A; 200/148 R

[58] Field of Search ..... 200/148 R, 148 A, 148 B

[56] References Cited

U.S. PATENT DOCUMENTS 4,983,789 1/1991 Thuries ..... 200/148 A

FOREIGN PATENT DOCUMENTS 0302390 2/1989 European Pat. Off. .

0380907 8/1990 European Pat. Off. .

2575595 7/1986 France .

*Primary Examiner*—J. R. Scott

*Attorney, Agent, or Firm*—Sughrue, Mion, Zinn, Macpeak & Seas

[57] ABSTRACT

A circuit breaker includes an insulating casing, a stationary main contact, a stationary arcing contact. A moving main contact and a moving arcing contact constituted by a tube define a blast cylinder co-operating with a first fixed piston. A second piston secured to a moving assembly includes the tube and slides in a second stationary cylinder. The volume between the two cylinders is put into communication with a volume adjacent to the casing or with a volume inside the tube via openings. An inertial ring selectively closes off the openings by moving between first and second extreme positions, the first position being one in which the openings are open and corresponding to a rest position for the moving assembly, and the second position being one in which the openings are closed.

6 Claims, 4 Drawing Sheets

HIGH- AND MEDIUM-VOLTAGE CIRCUIT BREAKER WITH LOWER OPERATING ENERGY

The present invention relates to a circuit breaker usable at high- or medium-voltage and of the type in which a gas having good dielectric properties such as sulfur hexafluoride $SF_6$ provides insulation and is also used for blasting the arc.

BACKGROUND OF THE INVENTION

French patent application No. 89 00 009, filed Jan. 2, 1989, corresponding to U.S. Pat. No. 4,983,789 describes a circuit breaker of the above-mentioned type as shown in axial half-section in FIG. 1, and comprising, for each phase: a cylindrical insulating casing (1) filled with $SF_6$ gas under pressure; a stationary arcing contact (3, 3A); and a moving assembly connected to a drive member and comprising: a moving main contact (5A); a moving arcing contact (4A); a blast cylinder (5) associated with a blast nozzle (6) and co-operating with a first piston (13); a second piston (14) secured to the moving assembly and sliding in a stationary second cylinder (8B). The section of the second piston is large relative to the section of the blast cylinder, said second piston being associated with means (15) for very low head loss communication with the arcing zone, said second piston being pierced by calibrated orifices (14C) to limit the pressure on the face of said piston that receives the gases heated by the arc.

In that circuit breaker, the moving arcing contact (4A) is constituted by a first end of a metal tube (4) coaxial with the casing (1) of the circuit breaker, the second end (4B) of said tube being, connected to the drive member. The second piston (14) is an annular piston outside the tube (4) and secured thereto. The low head loss communication means is constituted by large openings (15) pierced in the periphery of tube (4), the inside of the tube (4) being closed substantially level with the second piston 14 by means of a web (17).

The first piston (13) is semi-moving relative to the second cylinder (8B) and it abuts a slide (11) at one end. The slide (11) can take up two extreme positions in which a second end obstructs or leaves open, openings (10) in the second cylinder (8B) opening out into the volume V0 adjacent to the casing (1).

Those openings are radial chimneys 10.

It may be observed that the piston (14) carries a non-return valve (16) that is urged to close when the pressure on the face of the second piston (14) situated facing the arcing zone is greater than the pressure on the other face of piston (14).

SUMMARY OF THE INVENTION

An object of the present invention is to simplify the structure of the circuit breaker and to lighten its moving equipment. This can be done by eliminating the slide mentioned above. However, it is necessary to retain its function which is to avoid the pressure increases that may occur in the volume V2 between the first and second pistons when the circuit breaker is re-engaged. This problem is solved by means of a ring whose inertia is used when the circuit breaker is disengaged to keep closed openings that provide communication between the volume V2 and the volume V0 adjacent to the casing (1), and to open said openings when the circuit breaker is re-engaged.

The invention thus provides a circuit breaker comprising for each phase: a cylindrical insulating casing filled with $SF_6$ gas under pressure; a stationary main contact; a stationary arcing contact; and moving equipment connected to a drive member and comprising: a moving main contact; a moving arcing contact constituted by a tube; a blast cylinder terminated by a blast nozzle and co-operating with a first piston; a second piston secured to the moving equipment and sliding in a second stationary cylinder; the section of the second piston being large relative to the section of the blast cylinder; the volume between the two cylinders being capable of being put into communication with the volume adjacent to the casing, or with the volume inside said tube by means of openings; wherein said openings co-operate with a inertial ring capable of taking up first and second extreme positions, the first position being one in which said openings are open and corresponding to a rest position for the moving equipment, the second position being one in which the openings are closed and occurring during a large portion of the disengagement operation of the circuit breaker.

When the casing is disposed vertically, the inertial ring passes from the second position to the first position under gravity.

When the casing is disposed horizontally, the inertial ring passes from the second position to the first position under the action of a spring disposed inside the ring and bearing against a stationary portion of the circuit breaker.

In which case, the stroke of the inertial ring is limited by a stud secured to the ring and engaging in a slot formed in a stationary portion of the circuit breaker.

The openings may be formed through the second cylinder, the ring then sliding inside said second cylinder.

In a variant, the openings may be formed through the tube constituting the moving arcing contact, the ring then sliding inside said tube.

BRIEF DESCRIPTION OF THE DRAWINGS

Embodiments of the invention are described by way of example with reference to the accompanying drawings, in which.

DETAILED DESCRIPTION

Figure 1:
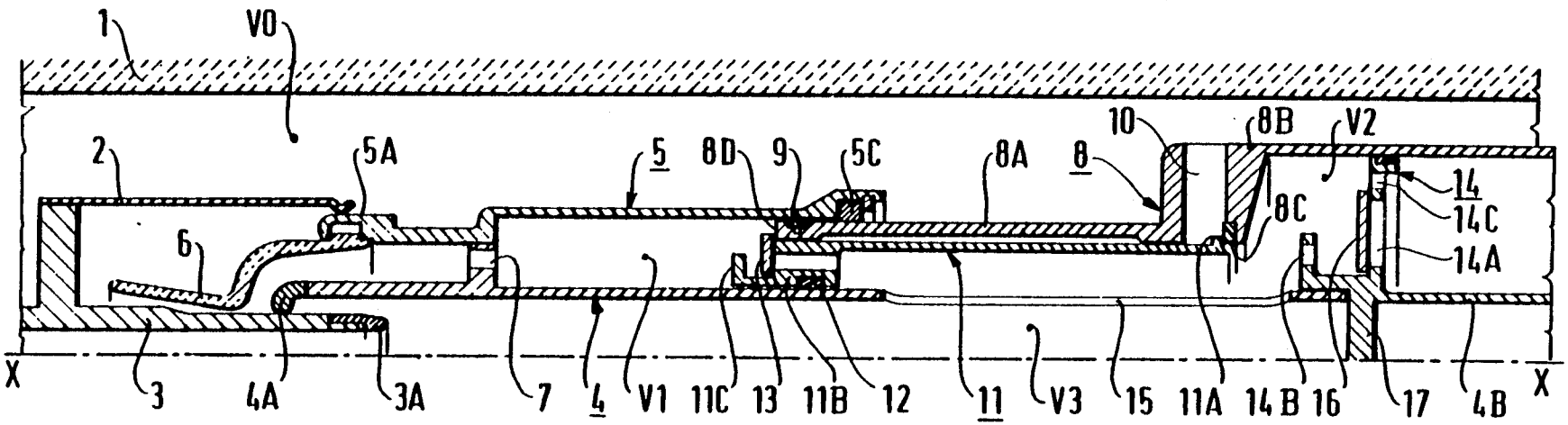
FIG.1 PRIOR ART
FIG. 1 is an axial half-section through a prior art circuit breaker.

In all drawings including FIG. 1 that shows the prior art, the same items therein bear the same reference numerals and letters. A brief description of the content of FIG. 1 follows, and the content of FIGS. 2 through 5 are modifications of the circuit breaker of FIG. 1.

The detailed description of the circuit breaker of FIG. 1 may be found in U.S. Pat. No. 4,983,789, and the present invention is an improvement on that circuit breaker. The circuit breaker comprises a casing 1 of insulative material of generally cylindrical shape having an axis X and delimiting an interior volume V0 filled with a dielectric gas. The circuit breaker includes a stationary main contact 2 and a stationary arcing contact 3 having an end made of an arc-resistant alloy. The circuit breaker includes a mobile assembly comprised of a tube 4 having one end 4A made from an arc-resistant alloy. The other end 4B of the tube is coupled to a drive mechanism (not shown). The tube 4 is connected to a larger diameter concentric tube 5, one end 5A of which constitutes the moving main contact of the circuit breaker. A blast nozzle 6 is fastened to tube 5. A plurality of outlet orifices from a blast volume V1 within the metal tube 4 are formed in a ring which joins the tubes 4 and 5, with the volume V1 opposite nozzle 6. A guide part indicated generally at 8 acts to guide the tube 5 carrying the moving main contact 5A. The guide part 8 includes a portion 8B which serves as a cylinder for the second piston 14. A seal 8C is provided for the slide 11 which is movable longitudinally to open and close chimneys 10 for communicating volume V2 between a first piston formed by annular non-return valve 13 and the second piston 14 of extension 4B of the moving arcing contact. The guide part 8 constitutes a third tube which is a fixed part of the circuit breaker and which is concentric about the first tube 4. The second tube 5 is integral with the first tube 4 and is concentrically positioned about the small diameter portion 8A of the guide part 8. The chimneys 10 constitute radial openings 10 within the portion of the guide part 8 which joins portions 8A and 8B of that guide part. The openings 10 are normally closed by a slide 11, an annular end 11A of which engages the circular seal 8C. The end 11A serves also to limit the travel of the slide 11 by coming into abutting relationship with the base of openings 10, opposite seal 8C. The slide 11 is generally tubular and has a tubular portion 11B which makes sliding contact with tube 4. At the opposite end of the slide 11, a seal 12 is provided between the slide and the metal tube 4, on which the slide 11 is guided at that end. A projection 8D on the guide part portion 8A engages the opposite side of the slide 11 from metal tube 4. The seal 12 is within a radially projecting portion of the slide which makes sliding contact with metal tube 4. A radially projecting flange 11C is carried by the part 11B and acts as a stop for the first piston 13, which is carried by slide 11 and which is free to move longitudinally between the flange 11C and the end face of the portion of the slide 11B. The first piston acts as a non-return valve to close off communication between volume V1 and V2 when in the position as shown in FIG. 1. The tube 5 acts in conjunction with tube 4 to constitute a blow-out cylinder for the circuit breaker. The piston 14 and the tube portions 8A and 8B partially delimit volume V2. A volume V3 lies internally of the smaller diameter metal tube 4. The piston 14 carries openings 14A selectively closed by an annular valve 16, which is shown in FIG. 1 in closed position, but which may move away from the piston 14 limited by a flange or abutment 14B, which is spaced axially slightly from piston 14. In addition to the openings 14A in the piston 14, there are a number of small calibrated openings 14C communicating volume V2 to volume V3. A web 17 closes off the end of volume V3 adjacent to the drive mechanism.

Figure 2:
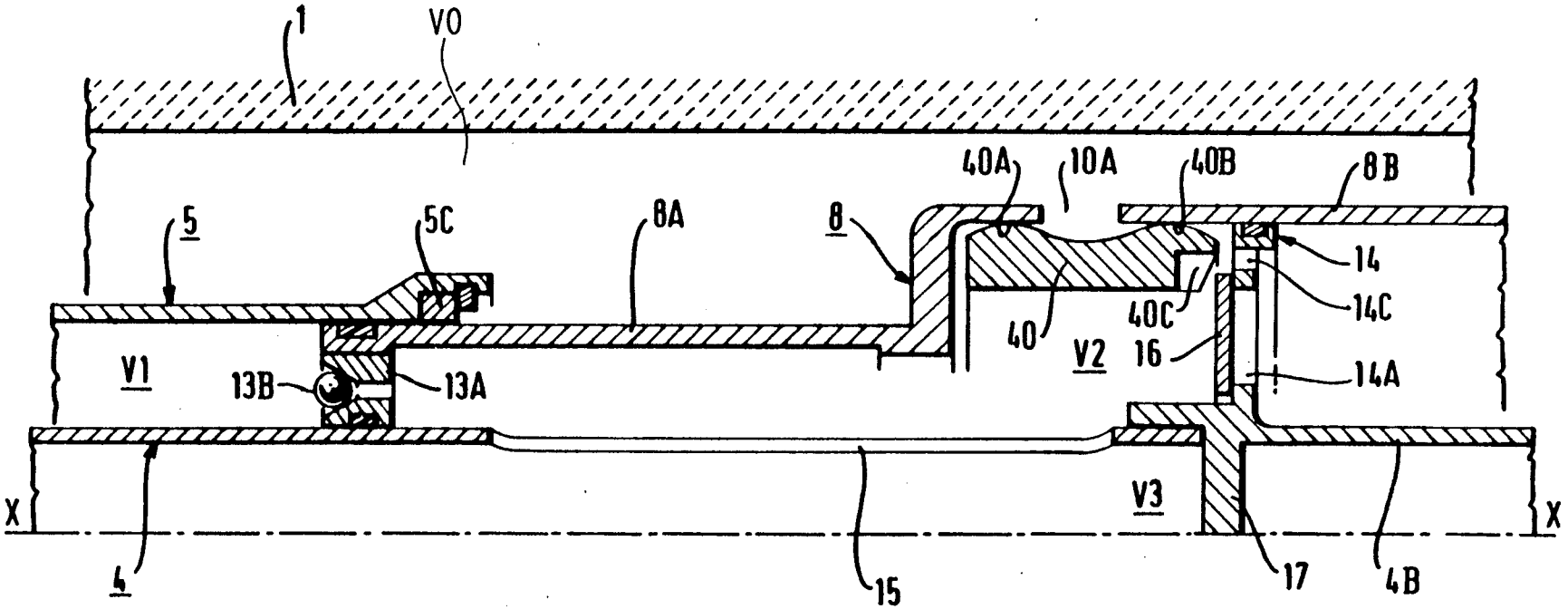
FIG. 2 is an axial half-section through a vertical chamber circuit breaker, constituting a first embodiment of the invention.

Items common to FIGS. 1 and 2 are given the same reference numerals. The portions omitted from FIG. 2 to the left of the blast volume V1 are identical to those of FIG. 1.

The circuit breaker of FIG. 2 differs from that of FIG. 1 in part, in that the slide 11 has been omitted. Further, the part 11B that serves as a guide therefor, the seals 12 and the non-return valve 13 are also omitted. The piston 13 is replaced by a ring 13A provided with a non-return valve 13B which opens when the pressure in the volume V2 becomes greater than the pressure that exists in the blast volume V1.

The chimneys 10 of FIG. 1 are omitted and replaced by mere openings 10A in tube 8B. The abutment 14B turns out not to be essential and has been omitted.

An inertial ring 40 now performs the function that used to be provided by the slide 11 and which was, firstly to seal the volume V2 when the circuit breaker is engaged so as to obtain maximum drive assistance due to the increase of pressure in said volume, and secondly to avoid any increase of pressure in the volume V2 on re-engagement so as to avoid increasing the amount of drive energy required.

The width of this inertial ring is sufficient to close the orifices 10A when the circuit breaker is in the engaged position (the position shown in FIG. 2) and its diameter is close to the inside diameter of the tube 8B. The inertial ring 40 carries spherical projections 40A and 40B at opposite axial ends to allow it to slide as a sliding fit inside the tube 8B. The inertial ring 40 is milled or recessed at 40C to avoid obstructing the holes 14C through the piston 14 and serving to limit the pressure exerted on said piston 14 during a disengagement operation.

Operation is as follows, recalling that the circuit breaker operates with its interrupting chamber disposed vertically: the axis XX is thus vertical with its bottom end being adjacent to the drive mechanism, shown to the right in FIG. 2.

When the circuit breaker is in the engaged position, the inertial ring rests on the valve 16.

The inertial ring is preferably made of steel.

When the circuit breaker is opened, the moving assembly is displaced to the right in the figure, but because of its inertia the inertial ring 40 remains practically stationary, thereby closing the orifices 10A and thus enabling pressure to rise in the volume V3 up to the limit set by losses due to the small orifices 14C, thereby assisting the drive for disengagement purposes. The inertial ring then falls onto the piston 14 which has moved to the right in FIG. 2.

On re-engagement, the inertial ring rises under drive from the piston 14 and excess pressure in the volume V2 is avoided since the orifices 10A remain open to the end of the operation.

Figure 3:
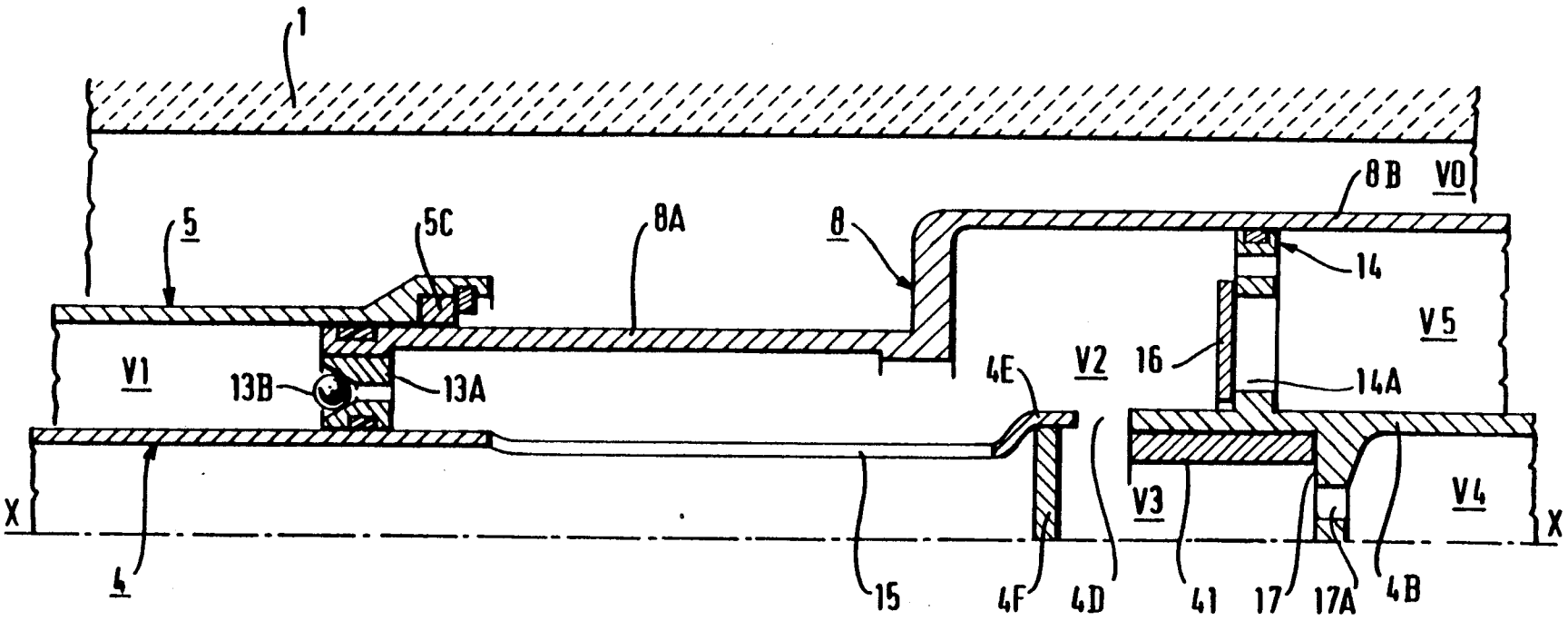
FIG. 3 is an axial half-section through a vertical chamber circuit breaker constituting a second embodiment of the invention.

The embodiment shown in FIG. 3 is a circuit breaker in which the chamber may be vertical or horizontal.

Items common to FIGS. 1 and 3 are given the same reference numerals.

In this embodiment, the openings 10A are omitted. The volume V3 is closed by an end wall 4F. Openings 4D are made through the tube 4 level with the volume V2 so as to put said volume V2 into communication with the volume V4 inside the tube 4B and evacuate excess pressure from said volume V4. To make this easier, the closure web 17 may have holes 17A. It may be observed that the volume V4 communicates with the volume V0 and with the volume V5 between the cylinders 4B and 8B.

The orifices 4D co-operate with an inertial ring 41 disposed inside the tube 4, which tube is given a small radial flare 4E to limit the stroke of the inertial ring 41.

Operation is as follows:

When the circuit breaker is in the engaged position (the position shown in FIG. 3), the inertial ring 41 occupies an indeterminate position between the end wall 4E and closure web 17.

When the circuit breaker is opened, the moving equipment is driven at high speed to the right in the figure. Because of its inertia, the inertial ring 41 remains stationary and thus closes the openings 4D, thereby closing the volume V2 from volume V3 and enabling the excess pressure in volume V2 to be fully applied against the valve 16, thus assisting the drive for opening purposes. At the end of this disengagement operation, the inertia of the ring causes it to continue to move, thereby uncovering the openings 4D, thus causing a second blast at the end of disengagement.

When the circuit breaker is reclosed, the inertial ring 41 remains against the web 17 because of its inertia, thereby leaving the orifices 40 open, thus enabling the excess pressure in the volume V2 to escape into the volume V4 through opening 4D and the orifices 17A.

Figure 4:
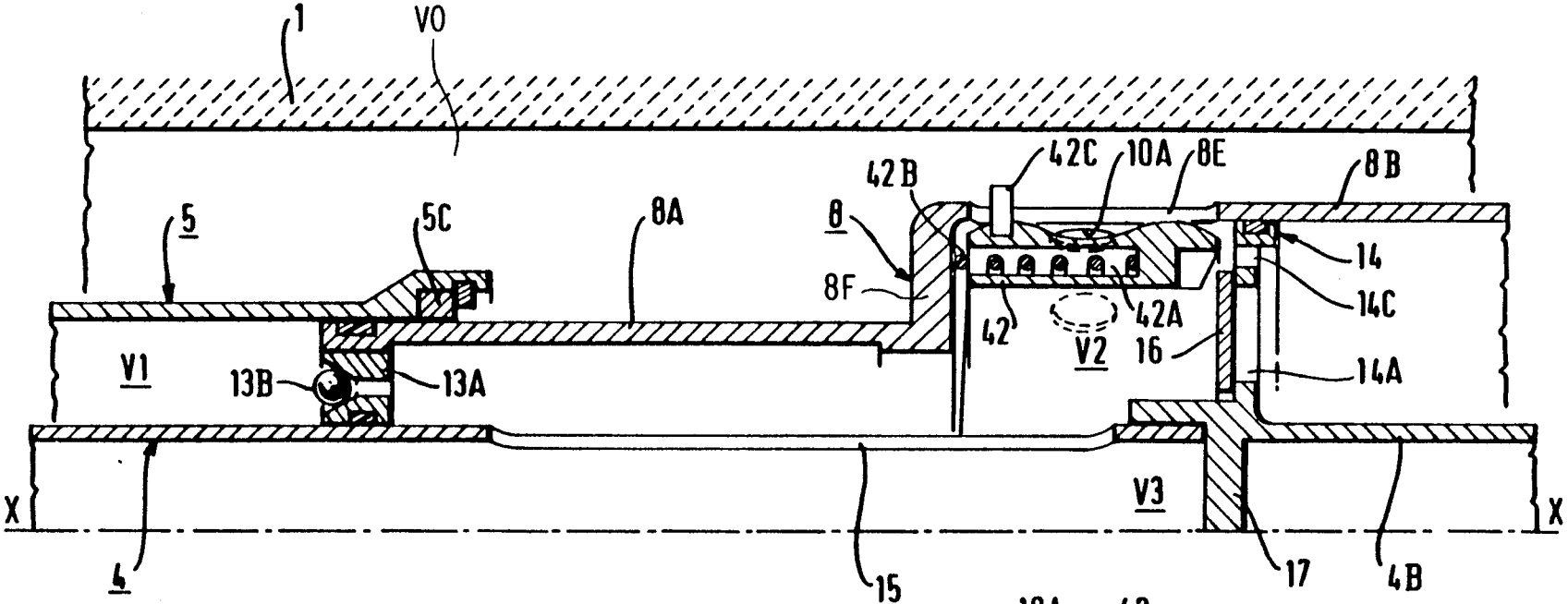
FIG. 4 is an axial half-section through a horizontal chamber circuit breaker of the invention constituting a third embodiment of the invention.
Figure 5:
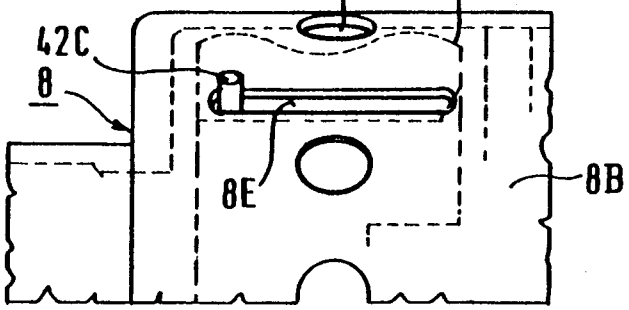
FIG. 5 is a fragmentary plan view of the circuit breaker of FIG. 4.

FIG. 4 shows a third embodiment of the invention for use in circuit breakers where the interrupting chamber is disposed horizontally.

This variant is an adaptation of the embodiment of FIG. 2, and that is why items that are common to FIGS. 4 and 2 are given the same reference numerals, with the exception of the inertial ring 42.

The inertial ring 42 is provided with an annular groove 42A in which a low-power spring 42B is received, bearing firstly against the end of groove 42A and secondly against the radial flange 8F on the part 8. The inertial ring has a radially projecting stud 42C that is engaged in a longitudinal slot 8E in the tube 8B for the purpose of limiting the axial stroke of the inertial ring 42.

Operation is the same as that described with reference to FIG. 2, the spring 42B serving to impart motion to the inertial ring equivalent to that imparted by gravity to a similar inertial ring 40 of FIG. 2, with the vertical axis of the circuit breaker.

Naturally, the variant of FIG. 4 can be applied to the ring of FIG. 3.

The invention serves to simplify the structure of circuit breakers while retaining properties of assistance on disengagement and energy saving on re-engagement.

I claim:

1. A circuit breaker comprising for each phase: a cylindrical insulating casing filled with a dielectric gas under pressure; a stationary main contact; a stationary arcing contact; and a moving assembly connectable to a drive member and comprising a first tube defining a moving main contact; a second tube, coaxial to said first tube and defining a moving arcing contact, said first and second tubes partially defining a blast first cylinder terminated by a blast nozzle and cooperating with a first fixed piston secured to one end of a fixed third tube coaxial to said first and second tubes and extending on the side of said first fixed piston, opposite to said cylinder; a second, movable piston secured to said second tube and sliding in a second cylinder defined by an extension of said second tube and an extension of said third tube; the surface area of the second piston being large relative to the cross-section area of the blast cylinder openings respectively in said extension of said third tube and in said extension of said second tube for placing a volume V2 between said two pistons into communication with a volume V0 adjacent to the casing, or with a volume V3 inside said second tube, an inertial ring mounted within said circuit breaker proximate to said second piston and movable axially between first and second extreme positions, and wherein said first extreme position is one in which said openings are open and corresponding to a rest position for the moving assembly, and the second extreme position is one in which the openings are closed and occurring during a large portion of the switching off operation of the circuit breaker.

2. A circuit breaker according to claim 1, wherein the casing is disposed vertically, the inertial ring passing from the second position to the first position under gravity.

3. A circuit breaker according to claim 1, wherein the casing is disposed horizontally, and said circuit breaker further comprising a spring disposed inside the inertial ring and bearing against a stationary portion of the circuit breaker and drawing the inertial ring from the second position to the first position.

4. A circuit breaker according to claim 3, wherein the stroke of the inertial ring is limited by a stud secured to the inertial ring and engaging in a slot formed in a stationary portion of the circuit breaker.

5. A circuit breaker according to claim 1, wherein said openings are formed through the second cylinder, and the inertial ring is mounted for sliding inside said second cylinder.

6. A circuit breaker according to claim 1, wherein said openings are formed through the first tube constituting the moving arcing contact, and said inertial ring is mounted for sliding inside said first tube.

* * * * *